United States Patent [19]

Shamie

[11] Patent Number: 4,706,312

[45] Date of Patent: Nov. 17, 1987

[54] DOUBLE ACTION CRIB DROP SIDE LOCK AND MATTRESS SUPPORT

[76] Inventor: Louis Shamie, 630 Ave. V, Brooklyn, N.Y. 11225

[21] Appl. No.: 916,220

[22] Filed: Oct. 7, 1986

Related U.S. Application Data

[63] Continuation-in-part of Ser. No. 673,476, Nov. 20, 1984, Pat. No. 4,639,956.

[51] Int. Cl.[4] ..... A47D 7/02

[52] U.S. Cl. ..... 5/93 R; 5/100

[58] Field of Search ..... 5/93 R, 100; 292/57, 292/60

[56] References Cited

U.S. PATENT DOCUMENTS

| | | | |
|---|---|---|---|
| 1,718,995 | 7/1929 | Barnard | 292/60 |
| 3,680,155 | 8/1972 | McMann | 5/99 R |
| 4,530,528 | 7/1985 | Shamie | 5/100 |
| 4,639,956 | 2/1987 | Shamie | 5/93 R |

*Primary Examiner*—Alexander Grosz
*Assistant Examiner*—Michael F. Trettel
*Attorney, Agent, or Firm*—Peter C. Michalos

[57] ABSTRACT

A double action securing device for the drop side of a crib comprises a guide member connected to the crib or to the drop side in a vertically oriented position. A slide member is slidably mounted to the guide member between two positions for raising and lowering the drop side. A catch pin is axially mounted to the slide member and engageable with an opening of the guide member in at least one of the relative positions. The catch pin has a head which defines a recess for embracing a lower edge of the guide member opening. The weight of the slide member causes the head recess to drop over the lower edge of the opening to lock the slide member with respect to the guide member.

A mattress support is used with the securing device. It has a frame defining a space comprising four vertical brackets connected to four posts of the crib frame. Each bracket has a plurality of vertically spaced open ended slots with open mouths of each slot facing toward a centerline of the crib. A pair of beams which each have pins extending from their end are engaged with the vertical brackets so that at least one pin at one end of each beam is engaged in one slot of each bracket. A cross member engages the beams to hold them apart and hold their pins in the appropriate slot.

13 Claims, 16 Drawing Figures

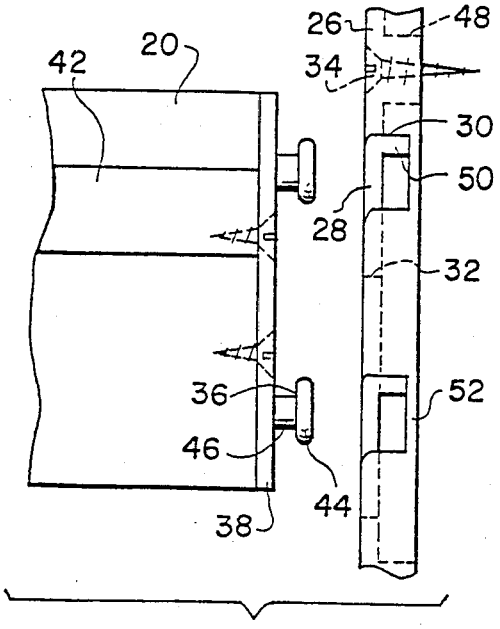
FIG. 3
FIG. 4
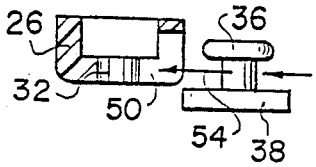
FIG. 5
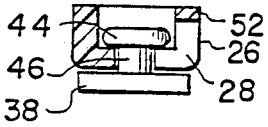
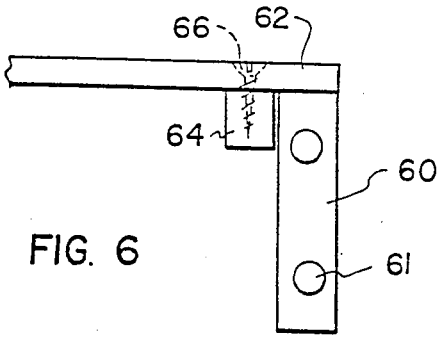
FIG. 6
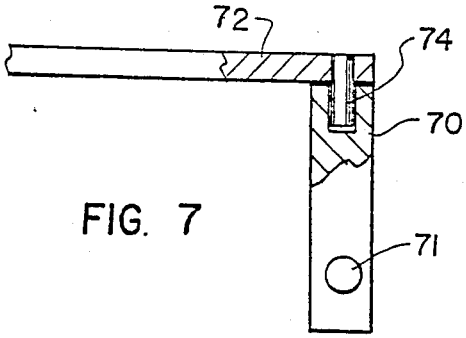
FIG. 7

FIG. 9
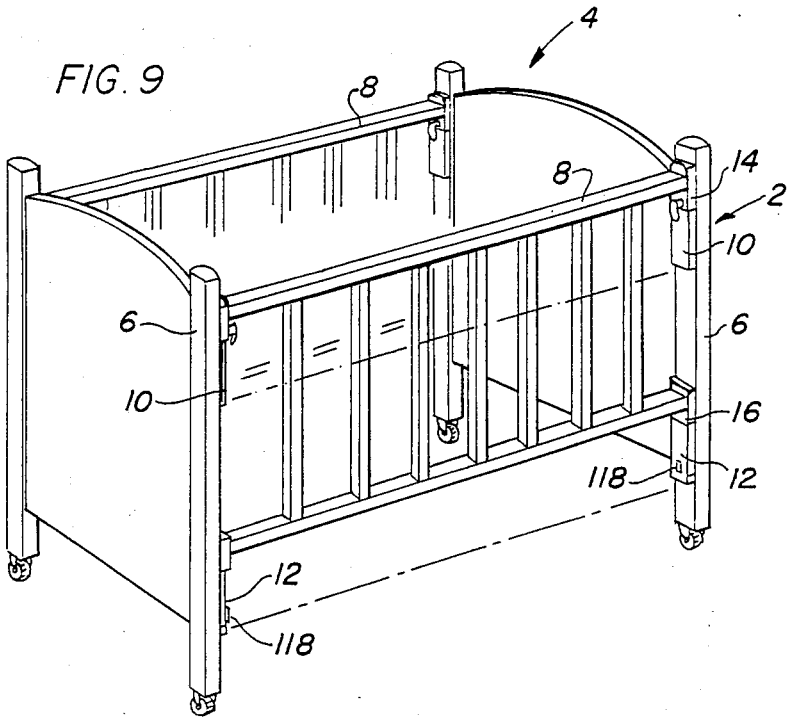
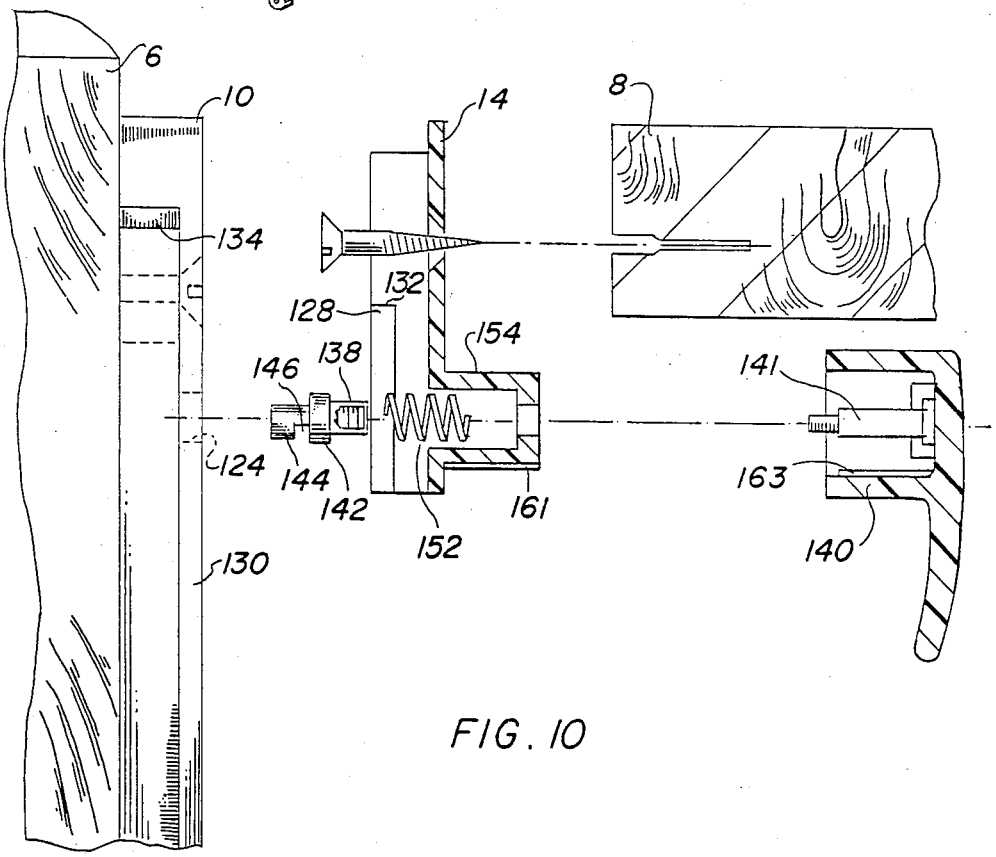
FIG. 10

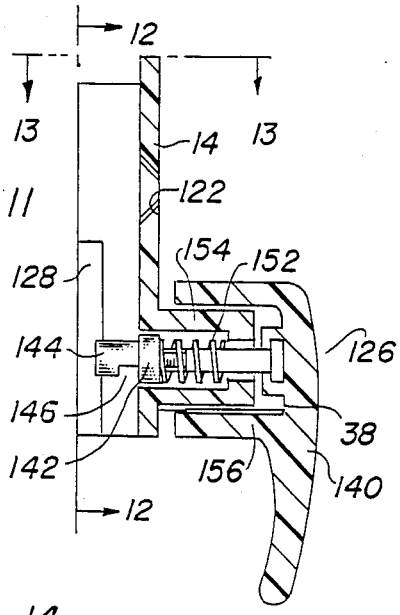
FIG. 11
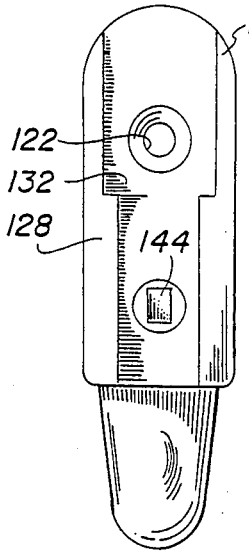
FIG. 12
FIG. 14
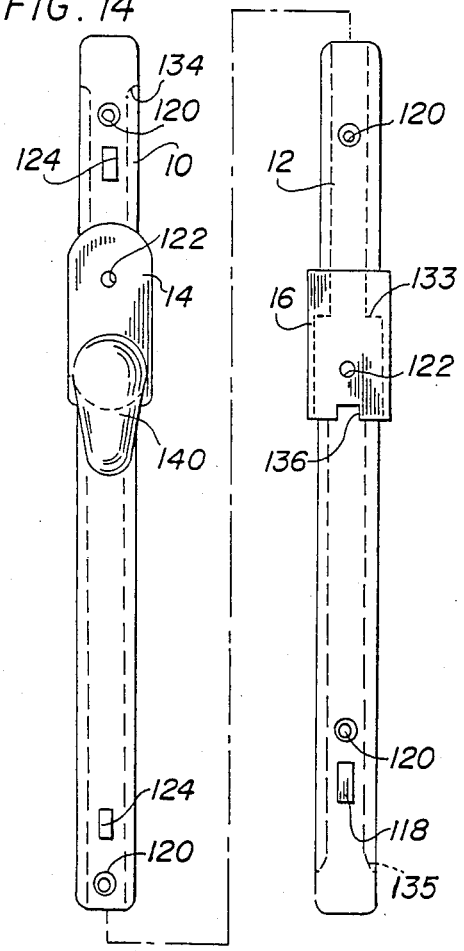
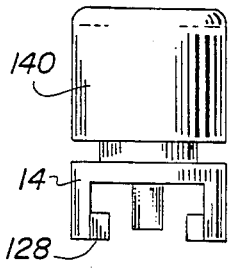
FIG. 13
FIG. 15
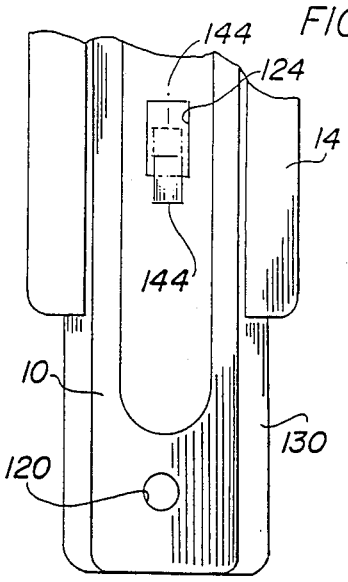
FIG. 16
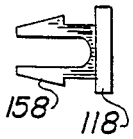

DOUBLE ACTION CRIB DROP SIDE LOCK AND MATTRESS SUPPORT

CROSS REFERENCE TO RELATED APPLICATION

This is a continuation-in-part application of the inventor's previous application having Ser. No. 73,476, filed Nov. 20, 1984 now U.S. Pat. No. 4,639,956 issued Feb. 3, 1987.

FIELD AND BACKGROUND OF THE INVENTION

The present invention relates in general to infant cribs and in particular to a new and useful mattress support and drop side lock for such cribs.

Cribs for growing infants generally include an adjustable mattress support which can position a mattress at a variety of vertical locations within the crib frame. Know mattress supports utilize four vertical brackets which have hooks or openings at spaced vertical locations which are meant to engage generally L-shaped bails. The bails are connected to a spring or other mattress carrying member. A suitable mattress is provided over the carrying member. U.S. Pat. No. 3,896,514 to Feldstein shows vertical mattress supports which include openings for receiving L-shaped bails which are mean to support a mattress.

The use of L-shaped bails or similar members requires that, when adjusting the height of a mattress, each bail must be moved separately from one location to another on the four vertical brackets. Another problem is that the bail are not positively connected to the vertical brackets in that they simply rest on hooks or in openings of the brackets. A dangerous condition thus exists. A normally active child for example, by jumping in the crib, may cause the mattress carrying support to jump, thus dislodging one or more of the bails from the vertical brackets.

Cribs which include drop sides or gates are also well known. Mechanisms must be provided for locking the drop sides of cribs in their respective raised or lowered positions. Since infants are involved, extra safety precautions must also be taken to ensure that the drop side, once locked in its raised position, will not inadvertently become unlocked and thus accidentally fall. To preclude such inadvertent unlocking, the use of double action mechanisms are highly desirable. Legislation has even been proposed for mandating such double action mechanisms in all infant related products.

A double action securing mechanism for the drop side of a crib has already been disclosed in U.S. Pat. No. 3,896,514 to Feldstein. In this Patent, T-shaped guides are connected to the frame members of a crib. Slides connected to the drop side of the crib are slidable mounted to the guides. A knob with an internal helical surface is mated with a post having an external helical surface connected to the slide. A pin with a head member is connected to the knob and axially movable into a key hole shaped opening in the guide, disposed at desired upper and lower positions for the drop sides. Rotation of the knob with the head extending into the key hole opening causes firm engagement of the head against an interior surface of the guide to firmly lock the slide with respect to the guide.

While this structure is effective in establishing a double action locking engagement between the drop side and the crib frame, improvements can be made toward simplifying the arrangement and increasing its durability and ease of operation.

A double action securing device for the drop side of a crib which utilizes a catch pin have a head defining a recess which is engageable in the opening of a guide member is known from the present inventor's U.S. Pat. No. 4,530,528 entitled DOUBLE ACTION CRIB DROP SIDE LOCK, issued July 23, 1985. In this patent the pin recess drops over a lower edge of the opening under the weight of a slide member and connected structure to which the pin is mounted. A double action requirement for unlocking the device is thus automatically established in that the slide member must first be raised with respect to the guide member and catch pin then axially withdrawn from the guide opening before the mechanism is disengaged. The guide member is connected either to the crib frame or to the drop side, with the slide member and its related parts connected to the drop side or crib frame respectively.

SUMMARY OF THE INVENTION

The present invention is drawn to an arrangement for safely locking the drop side of a crib and for supporting a mattress in a bed, and in narticular in a crib, which are more secure than known locks and mattress supports while at the same time being easier to adjust and assemble.

Accordingly, an object of the present invention is to provide a double action securing device for the drop side of a crib, comprising a guide member having an opening therein with a lowered edge and adapted to be connected to one of the drop side and crib, a slide member slidably mounted to the guide member for relative movement between raised and lowered positions with respect to the guide member, the slide member adapted to be connected to to the other of the drop side in the crib, and a catch pin axially mounted to the slide member, having a head defining a recess, with the head being of a size to pass into the opening and the opening positioned on the slide member for receiving the hold in one of the raised and lowered relative positions.

Another object of the present invention is to provide a mattress support for a crib having a frame which defined a space, the support comprising at least two and preferably four vertical members connected to the frame on opposing sides of the space, each vertical member having a plurality of vertically spaced open ended slots with each slot having an open mouth and a blind space, a mattress support member engaged with each vertical member, the mattress support having at least one pin insertable into one of the open mouths and seated in one of the blind spaces, and cross member engaged between the supports for holding them apart. This support is used in combination with the drop side lock to produce a crib which is safe and easy to assemble and operate.

A further object of the invention is to form the open ended slots of the support to have open mouths which face each other on opposite sides of a centerline of the crib so that the cross members in holding the support members apart also hold the pins in the blind spaces of the slots. In this way even violent movements of a child in the crib will not dislodge the support members from the vertical members.

A still further object of the invention is to provide a drop side lock and a mattress support which are simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is an exploded partial elevational view of a mattress support beam and a vertical support member which are engaged together to support a mattress;

FIG. 4 is a top sectional view showing the direction of movement for a part of the mattress beam for engaging its pins with a vertical bracket forming the vertical member;

FIG. 5 is a view similar to FIG. 4 showing the pin of the beam engaged with the bracket;

FIG. 6 is a partial elevational view of another embodiment of the invention;

FIG. 7 is a view similar to FIG. 6 with portions cut away and showing another embodiment of the invention;

FIG. 9 is a perspective view similar to FIG. 8 with a drop side which was missing from FIG. 1 fully installed and with the mattress support removed for clarity;

FIG. 10 is an enlarged partial exploded view of the drop side slide and lock mechanism with portions shown in section;

FIG. 11 is a sectional view of part of the assembled slide and lock mechanism of the invention;

FIG. 12 is a bottom plan view taken along lines 12—12 of FIG. 11;

FIG. 13 is a top plan view taken along lines 13—13 of FIG. 11;

FIG. 14 is a composite view showing the orientation of an upper guide member with locking slide member and a lower guide member with free sliding slide member;

FIG. 15 is a partial further enlarged bottom plan view of the guide member with engaged slide member; and FIG. 16 is a side elevational view of a stop member for establishing a lower position of the drop side when the crib is fully assembled.

DESCRIPTION OF THE PREFERRED EMBODIMENT

Figure 1:
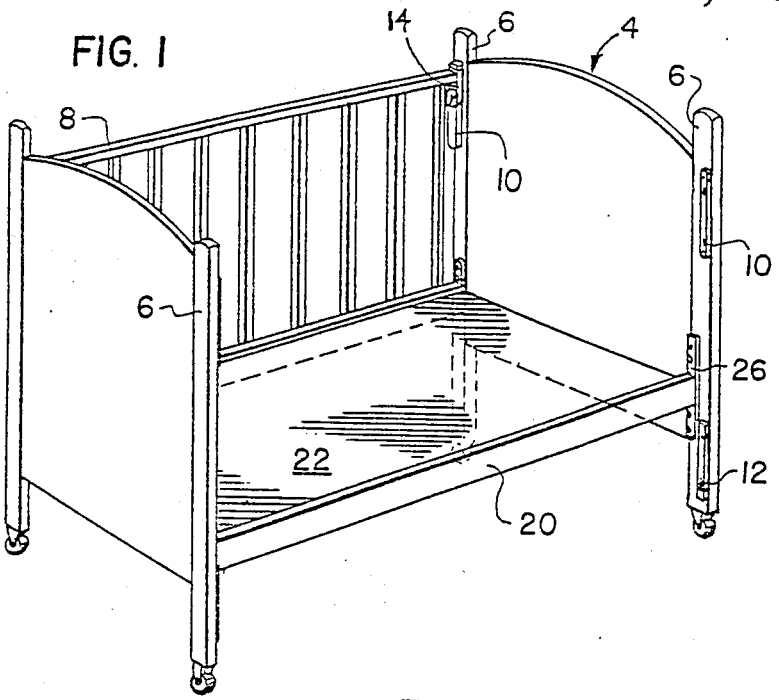
FIG. 1 is a perspective view of a crib with one drop side missing and showing the inventive mattress support.

In the drawings, FIGS. 1 to 7 deal mainly with the mattress support part of the invention while FIGS. 8 to 16 deal mainly with the drop side lock.

Referring to FIG. 1, the invention embodied therein comprises a support arrangement for the mattress of a crib generally designated 4 which comprises a frame made up of vertical posts 6. The frame defines an interior space which is bounded by the ends of the frame which are connected to the posts 6, as well as drop sides 8 (only one of which is shown). The drop sides are connected to upper and lower slides 14, 16, which slide vertically on guide members 10,12 connected to the posts or frame members 6. A safety arrangement for operating the drop sides 8 is disclosed in a co-pending application to the same inventor entitled DOUBLE ACTION CRIB DROP SIDE LOCK, Ser. No. 468,359, filed Feb. 22, 1983.

According to the present invention, a pair of support members or beams 20 span pairs of the vertical posts 6 and are connected to these posts at vertical members or brackets 26. Four brackets 26 are connected to the four posts 6. A cross member or plate 22 engages the beams 20 and is provided to support a mattress shown at 24 in FIG. 2.

Figure 2:
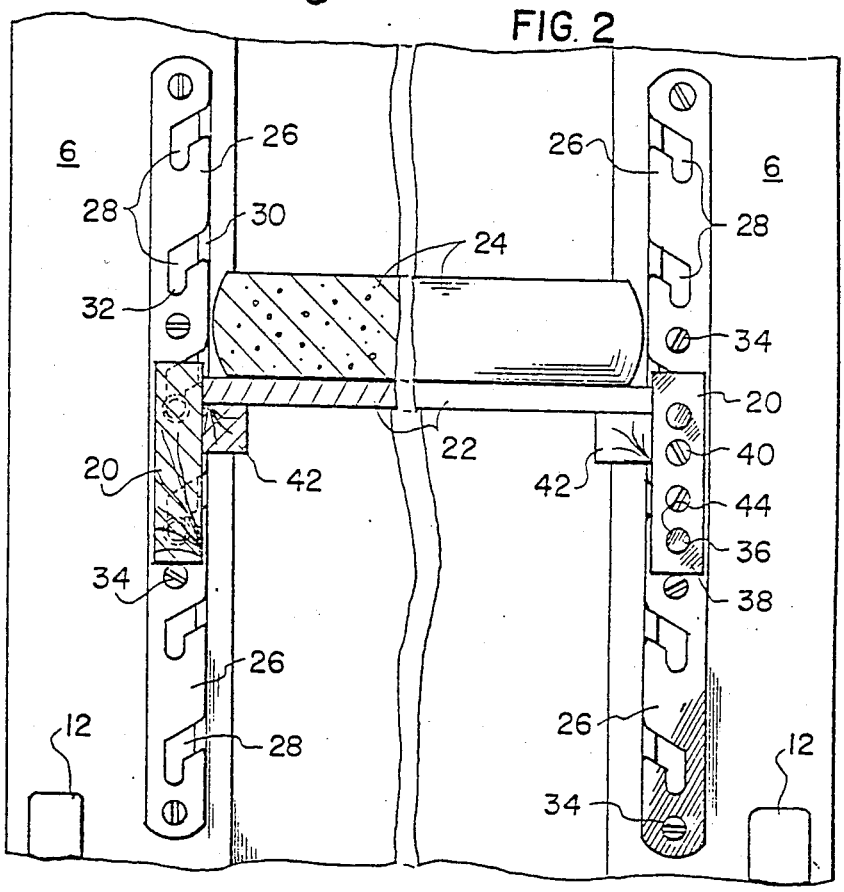
FIG. 2 is a side elevational view, partially in section, of an interior end wall of the crib in FIG. 1 showing additional details of the inventive mattress support.

As shown in FIG. 2, two of the beams 20,20 are on opposite sides of the space defined by frame posts 6. Each beam has a shoulder or stop member 42 which supports the 10 cross member 22.

Each vertical member 26 includes a plurality of vertically spaced open ended slots 28. Each slot 28 has an open mouth 30 which is also shown in FIGS. 3, 4 and 5. Each slot 28 also has a blind base 32 which is positioned below the mouth 30 of each slot.

Each beam 20 has a pin plate 38 connected to each and thereof as shown in FIGS. 2 through 5. Two pins 36 extend outwardly from each plate 38. Each pin 36 has a head 44 and a smaller diameter stem 46 which connects the head to the plate 38. The spacing between pins 36 on eaoh plate are equal to the spacing between adjacent slots 28 on each vertical member or bracket 26.

As apparent from FIG. 2, the open mouths 30 of one bracket face inwardly of the space defined by the crib frame, and actually face toward the open mouths of the slots on an opposing bracket 26. With the cross member of plate 22 in place between beams 20 and on shoulders 42, the beams 20 are held apart. The weight of the mattress holds the beams down so that it is virtually impossible to accidently dislodge the beams 20 from the brackets 26, even if an infant jumps up and down on the mattress 24. The worst that might happen is that the mattress plus its cross member 22 will bounce up but even this will not dislodge the pins 36 of the brackets 20 from their slots 28.

To initially engage the beams onto their respective vertical brackets, or to adjust the vertical position of the mattress, a beam 20 on one side of the crib is first positioned in the space defined by the frame posts 6 and then, with its pins 36 aligned with the mouths 30 of appropriate brackets 26, the beams are moved outwardly to engagement with the open mouths 30. As shown in FIG. 4, this moves beam plates 38 with their pins 36 in the direction of arrow 54. The mouth 30 of each beam has a vertical height which is at least as large as the diameter of the head 44 of each pin 36 so that the pin can easily enter the mouth. Each slot defines an inclined ramp 50 which produces a natural outward and downward movement of each beam. This continues until the head 44 is seated within the space defined by each bracket 26 (see FIG. 5) with stem 64 of each pin being seated in each blind base 32.

As shown in FIG. 2, the vertical brackets or members 26 are connected to posts 6 by screws 34. Plates 38 can be connected to the ends of the beams 20 by screws 40.

As shown in FIG. 2, screws 34 extend through thick web portions 38 of the brackets 26 which can be formed of high impact plastic or other suitable material. The open mouth 30 of each slot 28 is also doubled and curved to facilitate the easy entry of the pins 36.

While it is preferred that two pins be provided at each end of each beam, a single pin may also operate as long as the beam is otherwise held from rotation, for example by the shape and engagement of the cross member 22.

Although the cross member is shown as a plate in FIG. 2 for supporting mattress 24, two separate cross members might be provided at opposite ends of the beams for holding them apart. The support beam 20 also can be replaced by shorter support members which do not necessarily span the entire length of the crib but rather form a step or other engagement surface for supporting the cross member 22.

The cross member 22 can also be replaced by a box spring or spring frame of known design (not shown).

FIG. 6 shows an alternate embodiment of the invention wherein the stop mechanism between a cross member 62 and a support beam 60 is in the form of a shoulder member 64 connected to the cross member 62 by screws 66. Pins 61 are shown on beam 60.

FIG. 7 shows a still further embodiment of the invention wherein the stop mechanism comprises a pin 64 connected to a cross member 72 and seated in an opening at the top of a beam 70 which also carries one or more pins 71.

Referring now to FIGS. 8 to 16, the invention embodied therein comprises a double action securing device generally designated 2 for crib 4 having frame members 6 and vertically movable drop sides or gates 8.

Upper and lower guide members 10, 12 are connected to each frame member 6 for slidably receiving upper and lower slide members 14, 16. The slide members are connected to the upper and lower cross beams of drop sides 8 to permit vertical movement of the drop sides with respect to the crib frames as noted above.

Each lower slide member 16 is freely slidable on its guide member 12 and restricted from movement as the lower end of slide 12 by a stop member 118 shown in FIGS. 9 and 14.

Upper slide member 14 includes a double action locking arrangement illustrated in FIGS. 10 through 13, which is capable of locking the drop side in its raised and lowered positions.

As shown in FIG. 14, countersunk holes 120 are provided in the upper and lower guide members 10, 12 for admitting wood screws to connect the slides to the frame members 6. Countersunk holes lZZ are provided at the upper and lower slide members 14, 16 for admitting wood screws to fasten the slide members to the cross beams of the drop sides 8.

As will be explained in greater detail hereinunder, upper and lower openings 24 are provided in upper guide member 10 for receiving the end of a catch pin generally designated 26 in FIG. 2. Openings 24 both have parallel side edges, a lower edge and an upper edge. The slide members are pivotally connected to the drop sides however so they can pivot around these screws. This can be done by not fully tightening these screws.

Referring now to FIGS. 10–16 slide member 14 is channel shaped and includes flanges 128 which embrace flanges 130 in upper guide member 10 which is thus T-shaped. Lower guide member 12 is similarly shaped with lower slide member 16 having substantially the same cross sectional shape as upper slide member 14.

Flanges 128 merge with the side walls of slide member 14 and establish a stopping shoulder 132. As shown in FIG. 10 and in dotted line in FIG. 14, flanges 130 end in stop bevels or shoulders 134 on guide member 10. Shoulders 32, 34 form a stop for the upper movement of slide member 14. Similar shoulders 133, 135 are provided on lower guide and slide members 12, 16. In general, the downward sliding movement of slide 16 is stopped earlier by stop 118 which engages a recess 136 in the bottom of slide 16. Recess 136 and stop 118 is positioned to properly align catch pin 126 with lower guide member opening 124. Bevels 132, 134 for the upper guide and slide members is similarly effective to stop the upward movement of upper slide 14 at a point where the catch pin 126 is aligned with upper guide member opening 124. Before stop 118 is installed, slide 16 can slide lower on slide member 12. This is used to facilitate assembly of the crib (FIG. 8) as will be explained later.

Catch pin 126 includes a small diameter shank 138 which has an end connected, for examply by screwing, to an actuator knob 140. Shank 138 ends at a large diameter inner head 142 to which is connected an outer head 144. As shown in FIG. 15, head 144 is substantially rectangular in shape and is smaller than opening 124. The position of head 144 shown in solid line illustrates the double locked position thereof wherein a recess 146 defined by head 144 has engaged over a lower edge opening 124.

Lifting the drop side 8 brings head 144 into its dash dot position. Thereafter, knob 140 can be withdrawn against the bias of a spring 152 to withdraw head 144 clear of opening 124 and permit vertical sliding of slide member 14 on guide 10.

Slide 14 includes a cylindrical post 154 with a retaining cap end opening for receiving a pin 141 that is fixed to knob 140 and screwed into head 144. Spring 152 lies between head 142 and the shoulder of post 154. At abutting surface of inner head 142 which communicates with recess 146 engages on the outer casing surface of guide member 10 to limit the inward relative movement of catch pin 126 with respect to guide member 10.

As shown in FIG. 16, stop member 118 has flexible legs 158 which can be squeezed together to enter a suitably provided rectangular slot in lower guide member 12, and retains stop 118 therein.

With the exception of pin 126 and spring 152, virtually all the parts can be made of plastic or other suitable material. Spring 152 and pin 126 is preferably made of metal for strength but can also be made of nylon or any other material having sufficient strength.

While guide members 10, 12 are shown connected to the frame 6, the position of the slides and guides can be reversed, with appropriate modifications to the structure, for example a lengthening of catch pin 126 which may now extend through the frame members 6 to enage openings 124 of a slide connected to the drop sides 8.

To assemble the crib having the inventive drop side lock and mattress support of the present invention, the mattress support is first assembled. Thereafter, the two drop sides 8 are attached to the crib. FIG. 1 shows one of the drop sides already attached and in its upper position. Since both of the drop sides are attached in identical fashion, the attachment of only one drop side will be explained.

Figure 8:
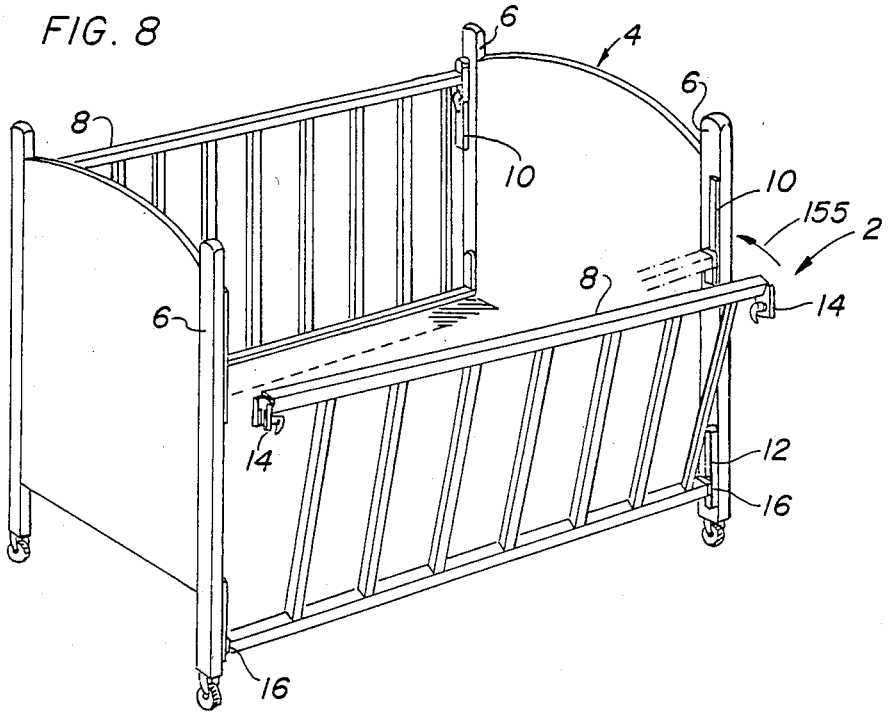
FIG. 8 is a perspective view used similar to FIG. 1 showing how the missing drop side can be installed, and indicating an initial position for the missing drop side.

Referring now to FIG. 8, to attach the remaining drop side on the otherwise completed crib shown in that figure, the lower slides are first engaged over the top of lower guide members 12. It will be recalled that the slides 14 and 16 are both pivotally connected to the drop side 8 so that an appropriate angle is established between the slides 16 and the drop side 8. Slides 16 are then lowered on guides 12 until shoulder 133 of slide 16 engages bevel or shoulder 135 on guide 12. It is noted that this is possible before the stop 118 is not in place. The space between shoulder or bevel 135 of lower guide 12, and the lower edge of upper guide 10 is selected to that with shoulders 133, 135 engage with each other, drop side 8 can be swung in the direction of arrow 155 to bring upper slide 14 immediately under the lower edge of upper guide 10. In this position(partially shown in dot dash line, FIG. 8) the knobs 140 are merged inwardly and together against their respective springs 152. Upper slides 14 can be slid up onto the lower end of upper guides 110. Thereafter, the head 144 can be engaged either in the lower or the upper openings 124 to move the drop side to its upper or lower position. It is most convenient at this point of the assembly to bring the drop side into its upper position so that the stop 118 can be installed onto the lower guide 112. Thereafter the drop side can be lowered only to the point where recess 136 of slide 16 engages stop 118. With shoulders 133, 135 engaged, the slide 14 should be at a position where it can be pivoted under guide 10. That is, with slide 14 parallel to the plane of drop slide 8,the upper edge of slide 14 would strike the lower edge of guide 10. To admit guide 10 into the top of the open channel in slide 14, therefore, slide 14 has to be pivoted. This admits the lower edge of guide 10 into the upper edge of the channel in slide 14. Thereafter the slide can be lifted fully onto guide 10 as explained above.

As shown in FIG. 10, post 154 has a slot 161 which receives a key 163 to prevent rotation of knob 140 on post 154.

While specific embodiments of the invention have been shown and described in detail to illustrate the principles of the invention, it will be understood the invention may be embodied otherwise without departing from such principles.

What is claimed is

1. A double action securing device in combination with a crib including a crib frame and at least one drop side vertically movable with respect to the frame, comprising:

an elongated upper guide member connected to the crib frame on each side of the drop side, each upper guide member having at least one opening therein with a lower edge, and each upper guide member having a lower end;

an elongated lower guide member connected to the crib frame on each side of the drop side, each lower guide member being beneath and being aligned with one of said upper guide members, each lower guide member having a lower shoulder near a lower end thereof;

an upper slide member slideably engaged with each of said upper guide members, each upper slide member being connected to one side of the drop side;

a catch pin mounted for axial movement to each upper slide member, each catch pin having a head for engaging into said opening of said upper guide member on which said upper slide member is slideably mounted, each head having a recess for engaging onto said lower edge of said opening for precluding axial movement of said catch pin out of said opening;

biasing means connected to each catch pin for biasing each catch pin in a direction into said opening of its respective upper guide member; and a lower slide member slideably engaged with each of said lower guide members, each lower slide member having a shoulder which is engagable with said lower shoulder of its respective lower guide member for precluding any further lowering of said lower slide member on its respective lower guide member, each lower slide member being pivotally connected to one side of said drop side below a respective upper slide member for permitting tilting of the drop side with respect to said upper and lower guide members;

the distance between said lower shoulder of each lower guide member and said lower end of each respective upper guide member being selected so that with said lower slide member shoulder engaged with its respective lower guide member shoulder, said upper slide members are positioned below said lower end of their respective upper guide members, the drop side being thereafter raisable to slide and said upper slide members onto their respective upper guide members.

2. A device according to claim 1 including a stop connected to each of said lower guide members near lower ends of said lower guide members, each stop being positioned above each respective lower shoulder of said lower guide members for stopping a lower sliding of said lower slide members at a position above the position in which said shoulders are engaged, said position of said lower slide members corresponding to a position of said upper slide members when said upper slide members are engaged on at least a portion of said upper guide members.

3. A device according to claim 1 wherein said heads of said pins and said openings of said upper guide members are rectangular.

4. A device according to claim 1 wherein each slide member includes a cylindrical post through which said catch pin extends, each catch pin having an inner head which is distinct from said first mentioned head, said recess of each catch pin being defined between said inner head and said first mentioned head, said biasing means comprising a spring engaged around said catch pin and between said inner head and said cylindrical post.

5. A device according to claim 4 including a knob fixed to an end of said catch pin which extends through said cylindrical post, said knob being engaged at least partly around said cylindrical post.

6. A device according to claim 5 including anti-rotation means engaged between said cylindrical post and said knob.

7. A device according to claim 6 wherein said anti-rotation means comprise a slot in said post and a key connected to said knob and slidably engaged in said slot.

8. A device according to claim 1 wherein each of said upper and lower slide members is channel shaped with a channel having a T-shaped cross section, said upper and lower guide members each having a T-shaped cross section engaged by their respective T-shaped cross section of said upper and lower slide members.

9. A device according to claim 8 wherein said lower slide members each have flanges forming said T-shaped cross section, said flanges carrying said shoulder of each lower slide member.

10. A mattress support and drop side lock for a crib having a frame with inner surfaces which define a space, said frame having one end and an opposite end and one side and an opposite sides, and a drop side vertically slidable on said frame between its ends the mattress support comprising:

a first pair of spaced apart vertical posts at the one end of the frame, each having an inner surface facing the opposite end of the frame;

a second pair of spaced apart vertical posts at the opposite end of the frame, each having an inner surface facing the one end of the frame;

a vertical bracket connected to each of said vertical posts, each vertical bracket being connected on said inner surface of its vertical post, each vertical bracket having a plurality of vertically spaced slots, each slot having an open mouth and a blind base positioned vertically below the open mouth, the open mouths of slots of each bracket at the one end of the frame facing each other and the open mouths of slots of each bracket at the opposite end of the frame facing each other, the blind bases of slots at each end of the frame being spaced from each other by a greater amount than the open mouths of slots at each end of the frame;

a pair of mattress support beams extending between said first and second pair of vertical posts, one of said mattress support beams being positioned on the one side of the frame and the other of said mattress support beams being positioned on the opposite side of the frame, each mattress support beam having a pair of fixed pins extending from each end thereof, each pair of fixed pins being insertable into a pair of said open mouths and being seated in a pair of said blind bases of a different vertical bracket, pins at one end of each beam being seated in blind bases of vertical brackets of said first pair of vertical posts and pins at an opposite end of each beam being seated in blind bases of vertical brackets of said second pair of vertical posts;

a cross member engaged between and on said pair of mattress support beams for holding each pin seated in its blind base, said cross member acting as stop means for holding said mattress support beams apart, said cross member extending substantially the full length of said mattress support beams from the one end of the frame to the opposite end of the frame and substantially spanning the distance between said support beams from one side of the frame to the opposite side of the frame;

the drop side lock comprising:

a pair of upper guide members connected to opposite ends of the frame, said guide members facing each other;

a slide member slideably mounted for vertical movement on each guide member, said slide members being connected to opposite ends of the drop side, said slide members all being pivotally mounted to the drop side for permitting tilting of the drop side with respect to the frame;

a catch pin axially mounted to each slide member, said catch pin having a head defining a recess for engaging said lower edge of each opening of said guide members when said head is in said opening of one said guide members, said head being of a size to pass into said guide member opening and said opening positioned on said guide member to receive said head in a selected relative position between said slide member and said guide member, said recess receiving said opening lower edge to lock said slide member to said guide member and so that said slide member can be unlocked from said guide member by first raising said slide member to withdraw said opening lower edge from said head recess and then axially withdrawing said head from said guide member opening; and biasing means engaged with said catch pins for urging said heads in a direction into said guide member openings.

11. A mattress support and lock according to claim 10, wherein each pin has a large diameter head and a small diameter stem, each open mouth having a vertical size at least equal to a diameter of said large diameter head and each blind base having a diameter smaller than that of said large head and at least equal to a diameter of said stem so that each stem is seated in a blind base of one of said slots.

12. A mattress support and lock according to claim 10, wherein such drop side lock includes a pair of lower guide members connected to opposite ends of the frame, said lower guide members being positioned below respective upper guide members and facing each other, a pair of lower slide members connected to opposite ends of the drop side, each lower slide member being mounted for sliding vertical movement to one of said lower guide members, each lower slide member having a shoulder and each lower guide member having a shoulder, said shoulders of said lower guide and slide members being engageable at a position where said first mentioned slide members are beneath a lower end of said first mentioned guide members whereby said catches can be moved against the force of said biasing means to raise the drop side and engage said first mentioned slide members onto said first mentioned guide members.

13. A mattress support and lock according to claim 12 including a stop member connected near a lower end of each lower guide member for engaging each lower slide member to hold each lower slide member at a position above the position whereat said shoulders are engaged, and corresponding to a position wherein said first mentioned slide members are engaged at least on a portion of said first mentioned guide members.

* * * * *